US007576599B2

(12) United States Patent
Huang et al.

(10) Patent No.: US 7,576,599 B2
(45) Date of Patent: Aug. 18, 2009

(54) VOLTAGE GENERATING APPARATUS

(75) Inventors: Hong-Yi Huang, Taipei (TW); Ru-Jie Wang, Taipei County (TW); Yuan-Hua Chu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/117,749

(22) Filed: May 9, 2008

(65) Prior Publication Data

US 2009/0146727 A1 Jun. 11, 2009

(30) Foreign Application Priority Data

Dec. 5, 2007 (TW) ..... 96146352 A

(51) Int. Cl.
*G05F 1/10* (2006.01)

(52) U.S. Cl. ..... 327/539; 327/513

(58) Field of Classification Search ..... 327/513, 327/530, 534, 535, 537, 539
See application file for complete search history.

(56) References Cited

U.S. PATENT DOCUMENTS 7,256,643 B2 * 8/2007 Pan et al. ..... 327/539

OTHER PUBLICATIONS

Article titled "A Low-Voltage Low-Power Voltage Reference Based on Subthreshold MOSFETs " authored by Giustolisi et al., IEEE Journal of Solid-State Circuits, vol. 38, No. 1, Jan. 2003 (pp. 151-154).

Article titled "A Sub-1-V 15-ppm/oC CMOS Bandgap Voltage Reference Without Requiring Low Threshold Voltage Device " authored by Leung et al., IEEE Journal of Solid-State Circuits, vol. 37, No. 4, Apr. 2002 (pp. 526-530).

Article titled "A CMOS Bandgap Reference Without Resistors " authored by Buck et al., IEEE Journal of Solid-State Circuits, vol. 37, No. 1, Jan. 2002 (pp. 81-83).

Article titled "A CMOS Voltage Reference Based on Weighted {Delta} VGS for CMOS Low-Dropout linear Regulators " authored by Leung, et al., IEEE Journal of Solid-State Circuits, vol. 38, No. 1, Jan. 2003 (pp. 146-150).

* cited by examiner

*Primary Examiner*—Jeffrey S Zweizig
(74) *Attorney, Agent, or Firm*—Jianq Chyun IP Office

(57) ABSTRACT

A voltage generating apparatus including a current source, a first voltage source, a second voltage source, a first differential pair, a second differential pair, a voltage divider and a current mirror is provided. The voltage divider is used for reducing a voltage with a negative temperature coefficient, so as to reduce the amplification ratio of the voltage with a positive temperature coefficient used for compensating the negative temperature coefficient.

21 Claims, 14 Drawing Sheets

VOLTAGE GENERATING APPARATUS

CROSS-REFERENCE TO RELATED APPLICATION

This application claims the priority benefit of Taiwan application serial no. 96146352, filed on Dec. 5, 2007. The entirety of the above-mentioned patent application is hereby incorporated by reference herein and made a part of this specification.

BACKGROUND OF THE INVENTION

1. Field of the Invention

The present invention relates to a voltage generating apparatus.

2. Description of Related Art

With blooming development of electronic technology, electronic products with various functions are provided. Since the electronic products are widely used, and marketing of the electronic products is global, a same kind of electronic product has to work normally under totally different environments. For example, a same kind of mobile phone will be sold to high-latitude countries with cold weather, and may also be sold to countries around the equator with hot weather. Or, a same mobile phone needs to be used under different environments due to relocation of a user. To cope with the aforementioned requirements, design of a circuit with a relatively high adaptability for different environments has become one of the major subjects to various designers.

In all electronic systems, there always exists some irreplaceable analog circuits, and these analog circuits generally require an accurate reference power supply for stability of circuit performance. Therefore, a plurality of so-called bandgap voltage generating apparatus is provided. A main feature of the bandgap voltage generating apparatus is its self-compensation capability of output voltage thereof when temperature is changed. FIG. 1 is a diagram of a conventional voltage generating apparatus having a temperature compensation capability. In the conventional voltage generating apparatus, features that collector current of two bipolar junction transistors (BJTs) Q1 and Q2 will be increased along with temperature (i.e. the so-called positive temperature coefficient) will be used for compensating an emitter-base voltage of the BJT which is decreased with increase of the temperature (i.e. the so-called negative temperature coefficient), so as to maintain an output voltage VREF unchanged.

However, besides requirement of outputting an accurate and stable voltage, control of power consumption of the circuit is also important. In the conventional voltage generating apparatus as shown in FIG. 1, since an input voltage of an amplifier AMP is limited, the amplifier AMP requires a relatively high system voltage for working normally, such that power consumption of the whole voltage generating apparatus is relatively high. Therefore, another voltage generating apparatus is provided, as shown in FIG. 2. FIG. 2 is a diagram illustrating a conventional voltage generating apparatus, in which the input voltage of the amplifier AMP is first divided by a resistor-series, and then is input to the amplifier AMP, and in coordination with a new amplifier AMP input circuit, working voltage of the amplifier AMP will be reduced, and accordingly power consumption thereof is reduced. By applying a new output circuit, the conventional voltage generating apparatus may generate an output voltage VREF of less than 1 volt.

FIG. 3 and FIG. 4 are diagrams respectively illustrating another conventional voltage generating apparatus. Different from the aforementioned conventional voltage generating apparatus, the voltage generating apparatus of FIG. 3 and FIG. 4 is composed of complementary metal oxide semiconductor. field effect transistors (CMOFETSs). Features of such kind of voltage generating apparatus is that cost of the CMOSFETs is relatively low, and the voltage generating apparatus applying the CMOSFETs is much easier to the output voltage VREF of less than 1 volt compared to the aforementioned voltage generating apparatus applying the BJTs.

FIG. 5 is a diagram illustrating a conventional voltage generating apparatus without any resistors. Such conventional voltage generating apparatus applies two current sources to turn on a diode D1 and a diode D2, so as to provide a voltage V1 and a voltage V2 to function as input voltages for two differential pairs 501 and 502. Wherein, the voltage V1 and the voltage V2 respectively have a negative temperature coefficient. Based on a ratio between the differential pair 501 and the differential pair 502, the output voltage VREF is composed of the voltage V2 and a difference between the voltage V2 and the voltage V1. Since the difference between the voltage V2 and the voltage V1 has the positive temperature coefficient, it may compensate the negative temperature coefficient of the voltage V2, such that the output voltage VREF remains unchanged when the temperature is changed.

FIG. 6 is a diagram illustrating an embodiment of a conventional voltage generating apparatus of FIG. 5 without resistors. Operational principle of this conventional voltage generating apparatus is the same to the circuit shown in FIG. 5, and therefore the description thereof is not repeated.

SUMMARY OF THE INVENTION

The present invention is directed to a voltage generating apparatus, which may reduce factors that cause negative temperature coefficient, so as to reduce circuit area thereof.

The present invention provides a voltage generating apparatus including a current source, a first voltage source, a second voltage source, a first differential pair, a second differential pair, a voltage divider and a current mirror. The current source is used for generating a first current, a second current, a third current and a fourth current. The ratio of the first current to the third current is 1:F, and the ratio of the second current to the forth current is 1:G, wherein, the F and the G are rational. Moreover, the first voltage source is coupled to the current source for generating a first voltage according to the first current, wherein the first voltage has a first negative temperature coefficient. The second voltage source is also coupled to the current source for generating a second voltage according to the third current, wherein the second voltage has a second negative temperature coefficient. It should be noted that the first negative temperature coefficient is less than the second negative temperature coefficient. The first differential pair has a first input terminal, a second input terminal, a common terminal and an output terminal, wherein the first input terminal of the first differential pair is coupled to the first voltage, the second input terminal is coupled to the second voltage, and the second current flows through the common terminal. To deserve to be mentioned, the amplify ratio of the first input terminal to the second terminal is A:AB, the A and the B are rational. The voltage divider is used for receiving the second voltage and dividing the second voltage for outputting a third voltage. The third voltage has a third temperature coefficient. And the ratio of third temperature coefficient to the second temperature coefficient is equal to the voltage dividing ratio providing from the voltage divider. Similarly, the second differential pair has a first input terminal, a second input terminal, a common terminal and an output terminal, wherein the first input terminal thereof is coupled to the third voltage, the second input terminal is coupled to the output terminal, and the output terminal outputs a fourth voltage. The fourth current flows through the common terminal of the second differential pair. The current mirror has a first terminal and a second terminal, wherein the first terminal is coupled to the output terminal of the first differential pair, and the second terminal is coupled to the output terminal of the second differential pair.

In the present invention, the voltage divider is used for reducing a negative temperature coefficient, so as to effectively reduce a circuit area of a positive temperature coefficient circuit used to be enlarged for compensating the negative temperature coefficient.

In order to make the aforementioned and other objects, features and advantages of the present invention comprehensible, a preferred embodiment accompanied with figures is described in detail below.

DESCRIPTION OF EMBODIMENTS

The present invention provides a voltage generating apparatus which may effectively achieve a temperature compensation effect while considering reduction of circuit cost. Technique features of the present invention will be described in detail below for reference to those skilled in the art.

Figure 7:
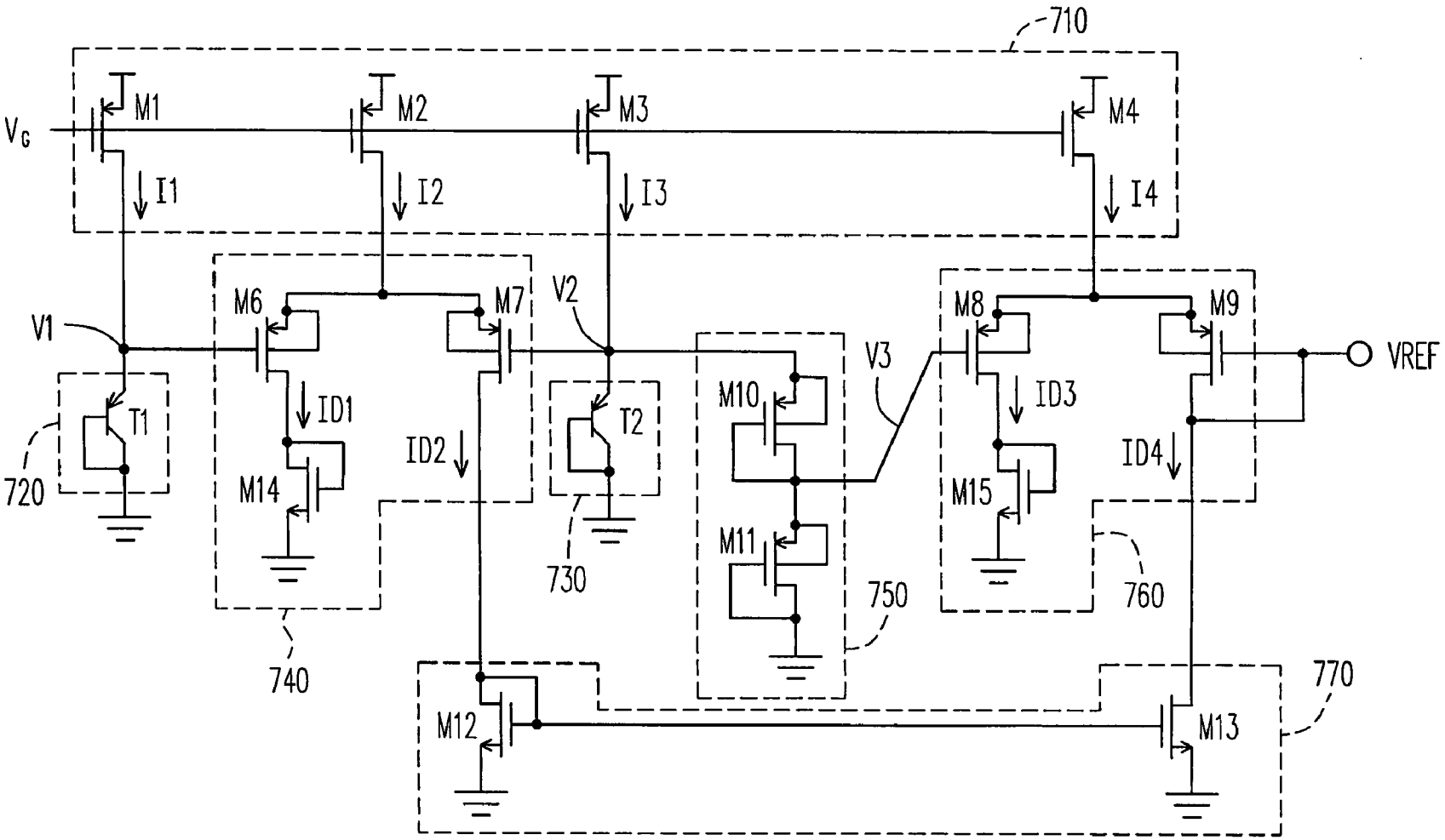
FIG. 7 is a circuit diagram illustrating a voltage generating apparatus having a temperature compensation capability according to an embodiment of the present invention.

FIG. 7 is a circuit diagram illustrating a voltage generating apparatus 700 according to an embodiment of the present invention. Referring to FIG. 7, the voltage generating apparatus 700 includes a current source 710, a voltage source 720, a voltage source 730, a differential pair 740, a voltage divider 750, a differential pair 760 and a current mirror 770. The current source 710 is used for receiving a voltage $V_G$ from a control terminal and generating a first current I1, a second current I2, a third current I3 and a fourth current I4, wherein a ratio between the first current I1 and the third current I3 is 1:F, and the ratio between the second current I2 and the fourth current I4 is 1:G, wherein F and G are all rational numbers.

The voltage source 720 and the voltage source 730 respectively receive the first current I1 and the third current I3 for generating a first voltage V1 and a second voltage V2. The differential pair 740 receives the first voltage V1 and the second voltage V2 as input voltages, and is coupled to the current source 710 for receiving a current ID2 as a bias current. The voltage divider 750 is coupled to the second voltage V2 for dividing the second voltage V2 to generate a third voltage V3. Similar to the differential pair 740, the differential pair 760 is also coupled to the current source 710. for receiving the fourth current I4 as the bias current. The input voltage for one of input terminals of the differential pair 760 is the third voltage V3, another input terminal of the differential pair 760 is coupled to an output terminal thereof for outputting a fourth voltage VREF, which is an output voltage of the voltage generating apparatus 700.

Figure 1:
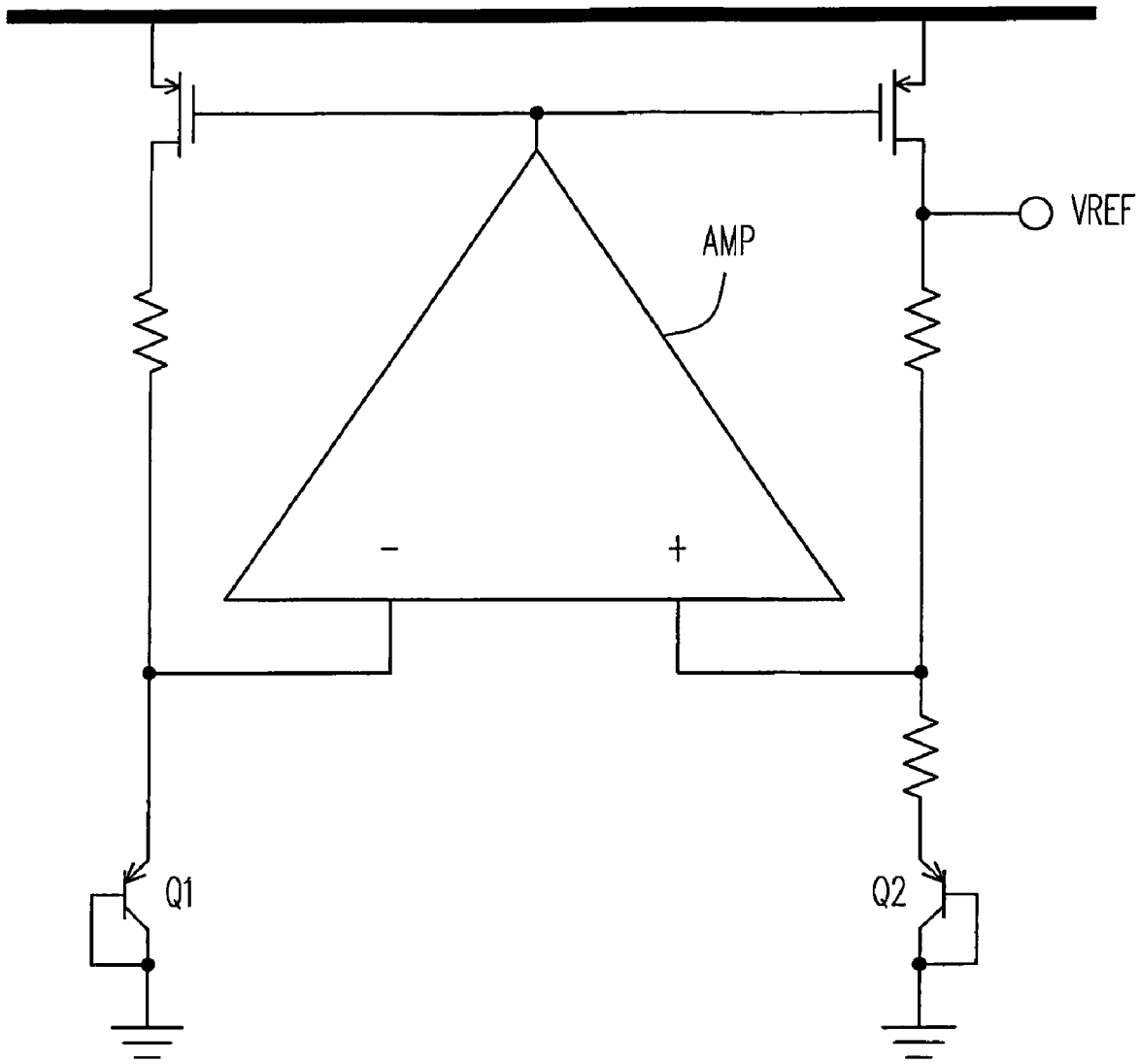
FIG. 1 (PRIOR ART)
FIG. 1~FIG. 6 are circuit diagrams illustrating conventional voltage generating apparatus having a temperature compensation capability.
Figure 2:
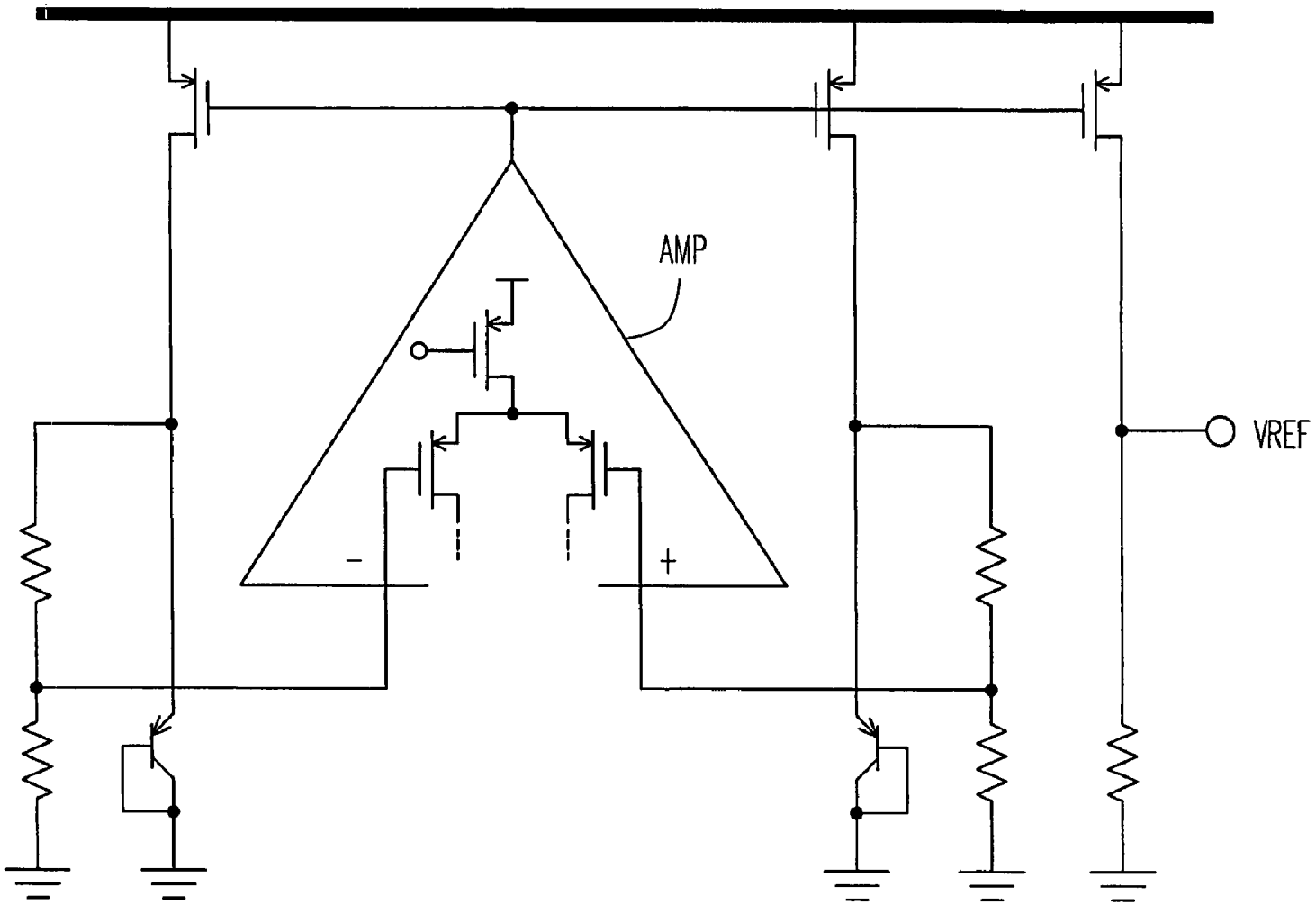
FIG. 2 (PRIOR ART)
Figure 3:
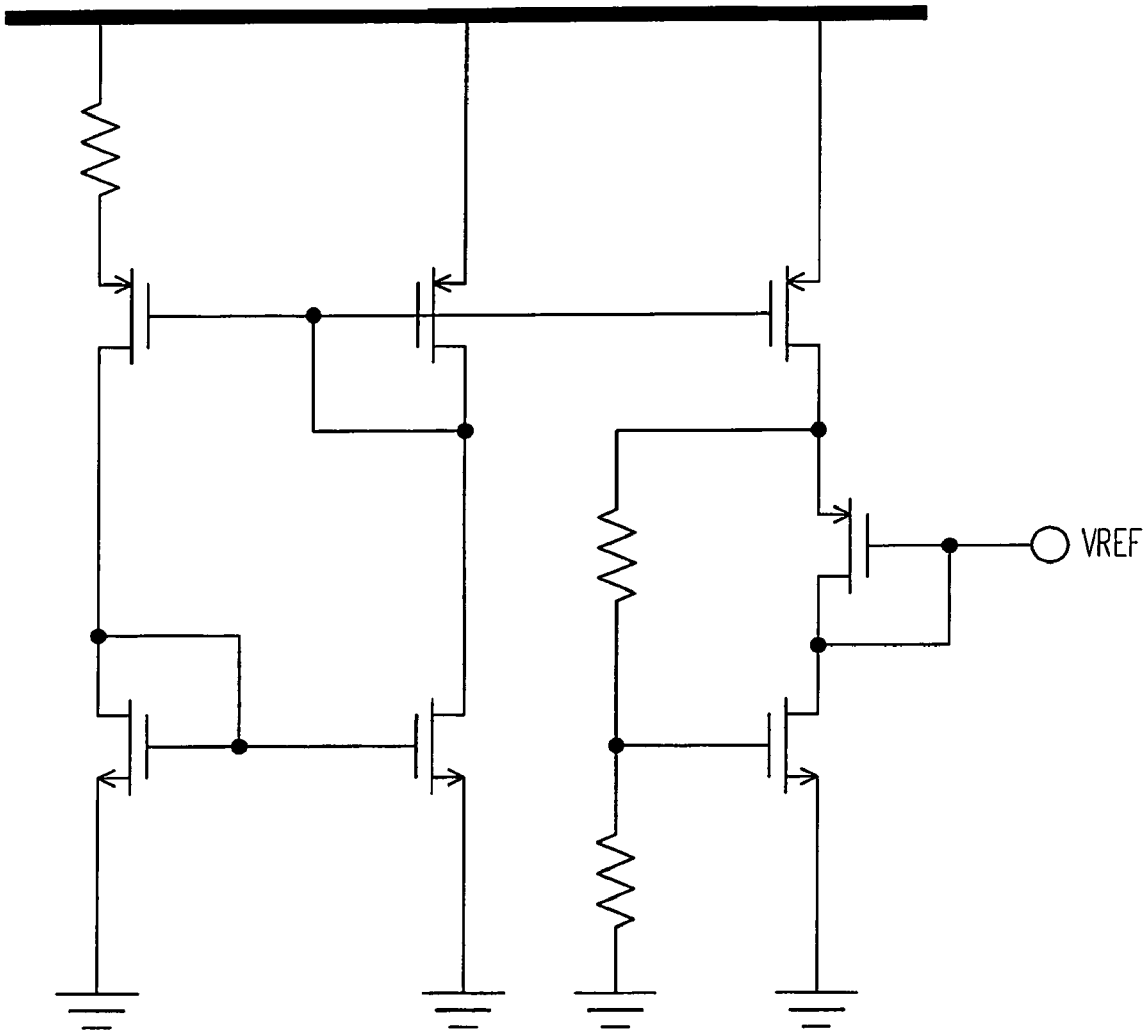
FIG. 3 (PRIOR ART)
Figure 4:
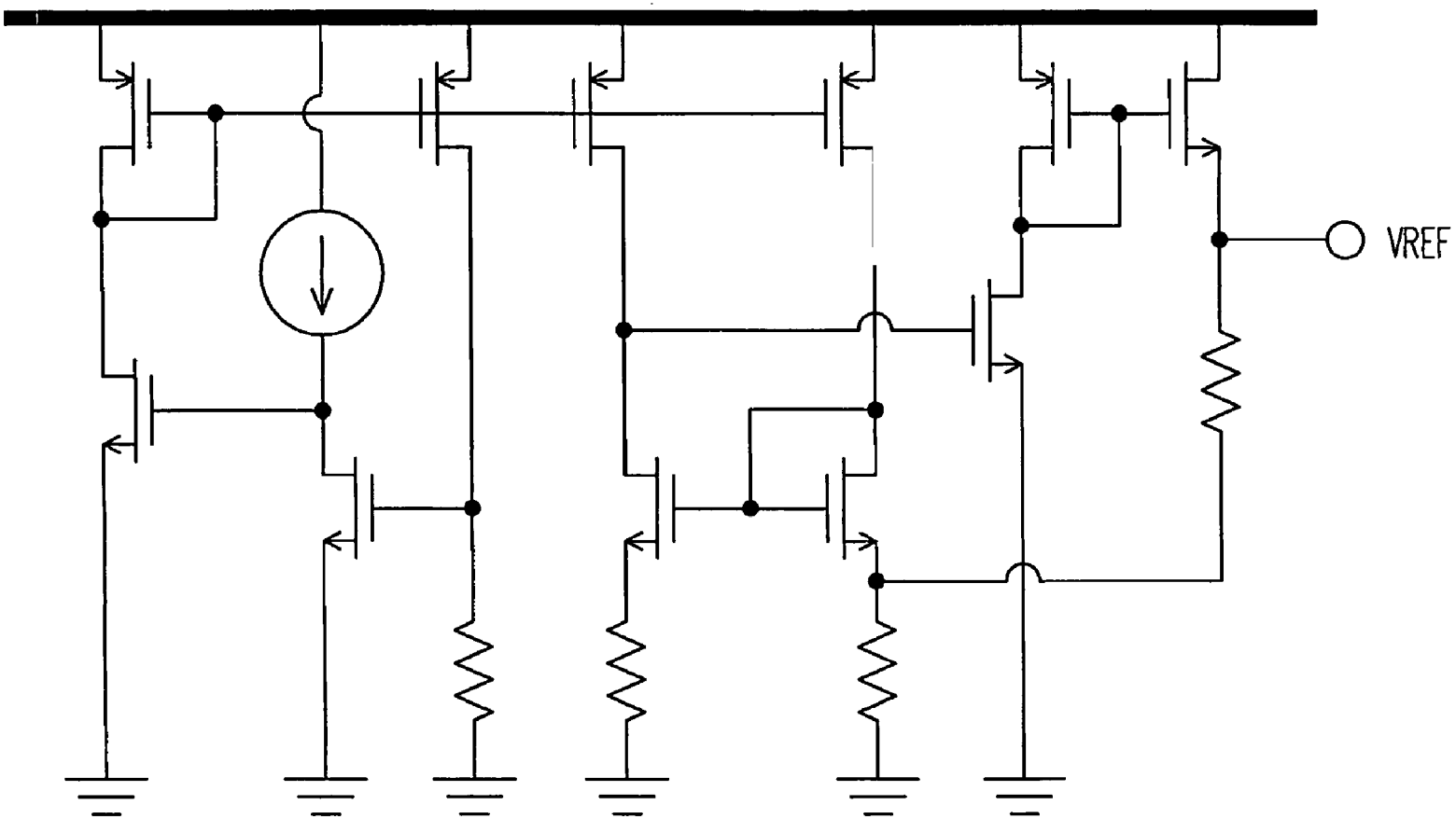
FIG. 4 (PRIOR ART)
Figure 5:
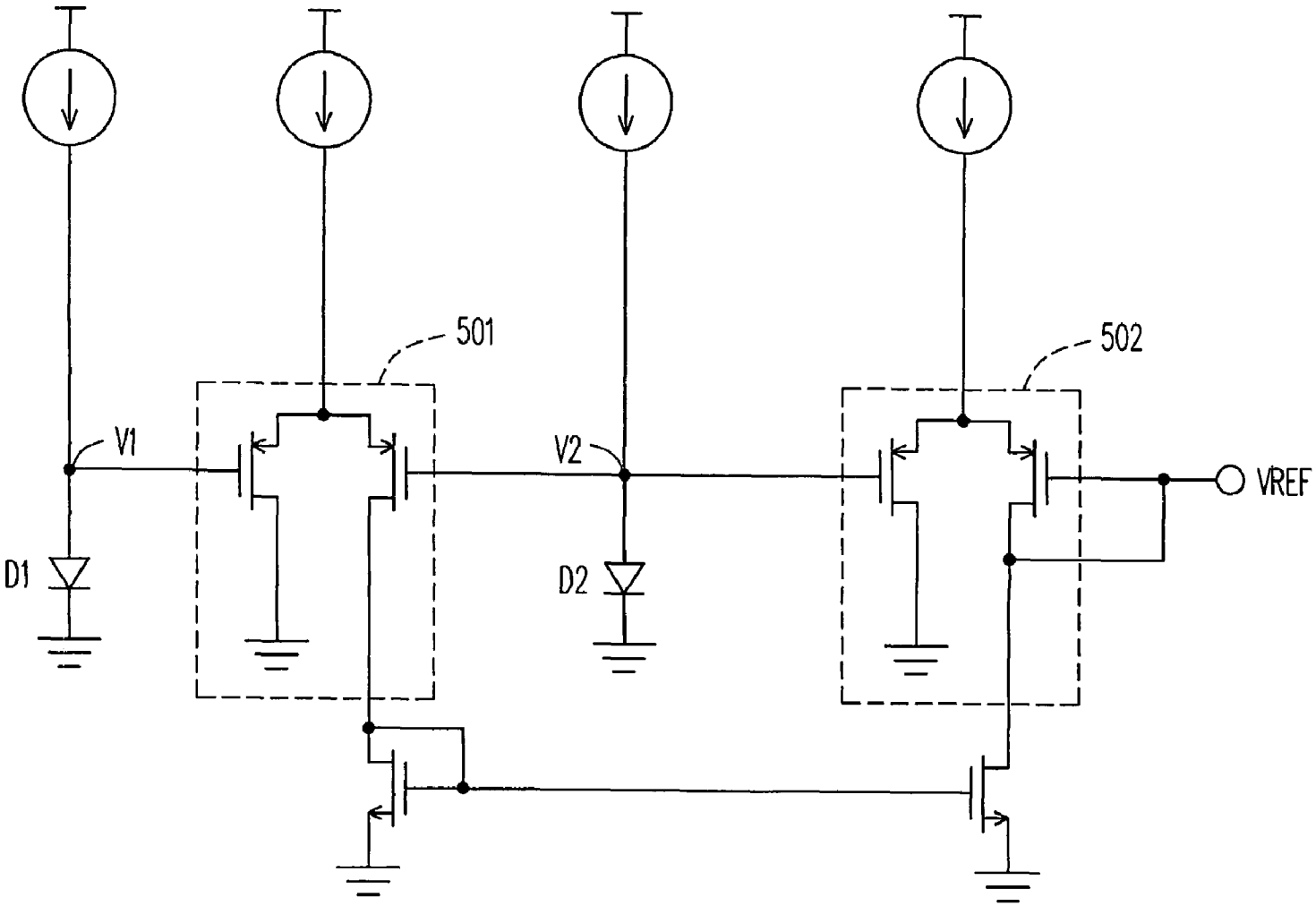
FIG. 5 (PRIOR ART)
Figure 6:
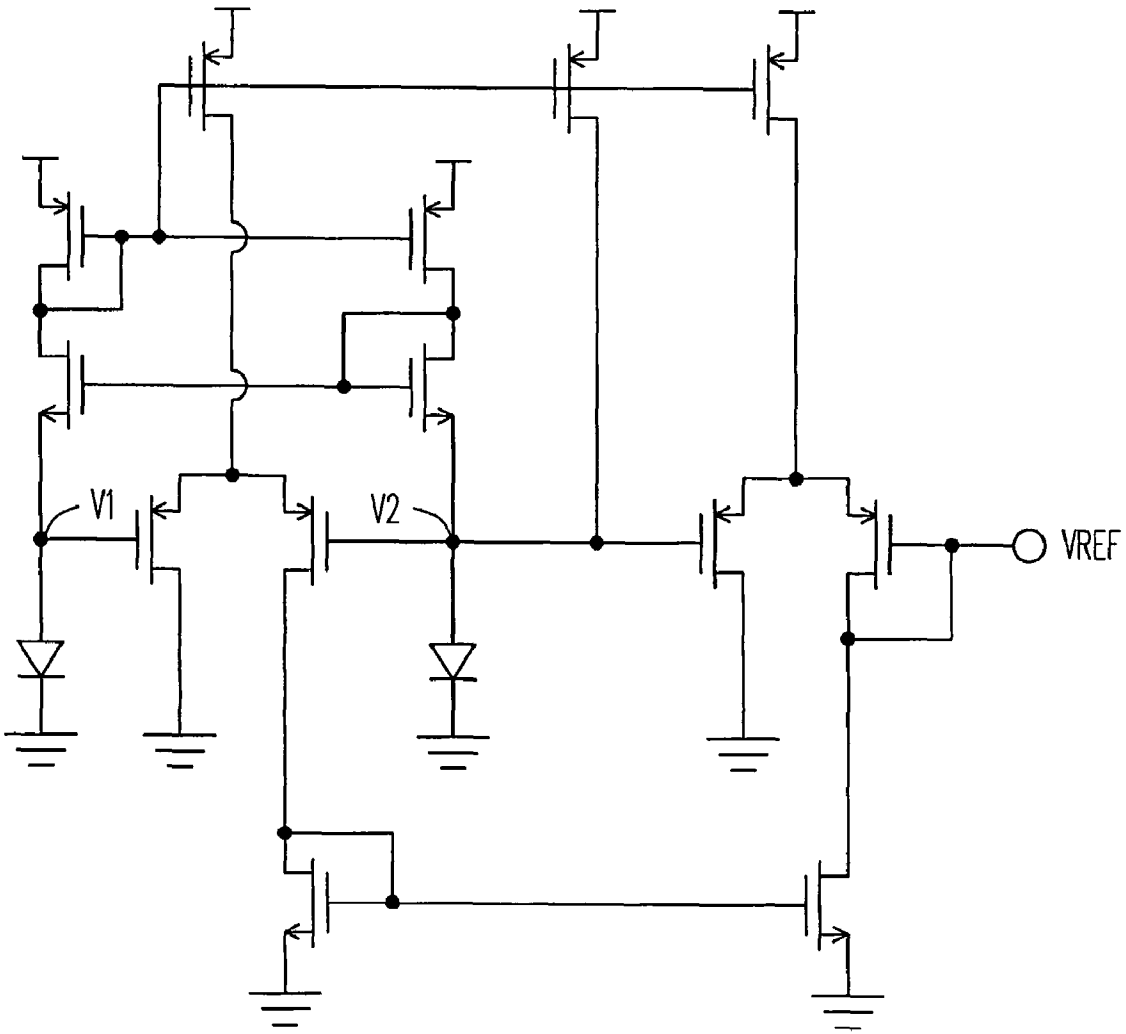
FIG. 6 (PRIOR ART)

Referring to FIG. 7 again, the first voltage V1 and the second voltage V2 all have a negative temperature coefficient. In the present embodiment, by adjusting the voltage source 720 and the voltage source 730, the negative temperature coefficient of the first voltage V1 will be less than that of the second voltage V2 (i.e. an absolute value of the negative temperature coefficient of the first voltage V1 is greater than the absolute value of the negative temperature coefficient of the second voltage V2). In the differential pair 740, the first voltage V1 is subtracted from the second voltage V2 to obtain a voltage difference ΔV having a positive temperature coefficient. An output current of the differential pair 740 is amplified for G (wherein G is a rational number) times by the current mirror 770, and is transmitted to the output terminal of the differential pair 760. Moreover, since a size of the differential pair 740 is A times compared to that of the differential pair 760, contribution of the voltage difference ΔV for the fourth voltage VREF is amplified for $\sqrt{A\times G}$ times. The voltage divider 750 receives and divides the second voltage V2 to generate the third voltage V3, and the third voltage V3 is transmitted to the input terminal of the differential pair 760. Thus, the fourth voltage VREF will be represent by a following mathematic equation:

$$VREF=V2+\sqrt{A\times G}\times(V2-V1)=V3+\sqrt{A\times G}\times\Delta V$$

wherein the third voltage V3 has the negative temperature coefficient, and the voltage difference ΔV has the positive temperature coefficient. Therefore, by adjusting $\sqrt{A\times G}$, range of the fourth voltage VREF varying along with the temperature will be effectively compensated. It should be noted that since the third voltage V3 is generated by voltage dividing of the voltage divider 750, negative temperature coefficient of the third voltage V3 decreases accordingly. A ratio between the negative temperature coefficient of the third voltage V3 and the negative temperature coefficient of the second voltage V2 equals to a voltage dividing ratio of the voltage divider 750. Therefore, unlike a conventional technique as that shown in FIG. 5, enlargement of circuit area to increase a value of $\sqrt{A\times G}$ is unnecessary in the present embodiment.

In the following description, operation of the circuit of the present embodiment is further described with reference of equations, so as to fully convey the spirit and principle of the present invention to those skilled in the art.

Referring to FIG. 7 again, the current source 710 includes four transistors M1, M2, M3 and M4. Gates of the four transistors are commonly coupled to the control terminal $V_G$ for respectively generating the first current I1, the second current I2, the third current I3 and the fourth current I4.

The current source 720 includes a diode composed of a transistor T1. A base and a collector of the transistor T1 are coupled to a ground voltage, and an emitter of the transistor T1 receives the first current I1. Here, the emitter of the transistor T1 is equivalent to an anode of the diode, and the base and the collector thereof are equivalent to a cathode of the diode. The transistor T1 is turned on in response to the first current I1 and generates the first voltage V1. Similarly, the voltage source 730 also includes a diode composed of a transistor T2. A base and a collector of the transistor T2 are coupled to the ground voltage, and an emitter of the transistor T2 receives the third current I3. Here, the emitter of the transistor T2 is equivalent to an anode of the diode, and the base and the collector thereof are equivalent to a cathode of the diode. The transistor T2 is turned on in response to the current I3 and generates the second voltage V2. It should be noted that the transistor T1 and the transistor T2 may also be substituted by other semiconductor devices that may form the diode, which is not limited to the transistors T1 and T2 shown in FIG. 7.

In addition, the differential pair 740 includes a transistor M6 and a transistor M7, wherein a gate of the transistor M6 is coupled to the first voltage V1, and a first source/drain and a base thereof are coupled to the common terminal of the differential pair 740, and a second source/drain thereof is coupled to the ground voltage. Moreover, a gate of the transistor M7 is coupled to the second voltage V2, and a first source/drain and a base thereof are coupled to the common terminal of the differential pair 740, and a second source/drain thereof is coupled to the current mirror 770. The second current I2 flows through the common terminal of the differential pair 740 to function as the bias current. The differential pair 740 further includes a transistor M14, wherein a first source/drain and a gate of the transistor M14 are coupled to the second source/drain of the transistor M6, and a second source/drain of the transistor M14 is coupled to the ground voltage. The transistor M14 is used for balancing a channel size between the transistor M6 and the transistor M7 during chip fabrication, so as to reduce fabrication errors thereof.

In the present embodiment, the voltage difference ΔV is generated by subtracting the first voltage V1 from the second voltage V2 via the differential pair 740. An amplifying ratio of the differential pair 740 is A:AB, wherein A and B are all rational numbers. The second current I2 is shunted into two currents within the differential pair 740, wherein the current flows through the transistor M6 is a current ID1, and the current flows through the transistor M7 is the current ID2. A relation among the voltage difference ΔV, the current ID1 and the current ID2 is represented by a following mathematic equation (1):

$$V2 - V1 = \sqrt{\frac{2 \times ID1}{\mu_{eff1} \times C_{ox} \times S1}} - \sqrt{\frac{2 \times ID2}{\mu_{eff2} \times C_{ox} \times S2}} = \Delta V \quad (1)$$

wherein $C_{OX}$ is the gate oxide capacitance per unit area, $_{eff1}$ and $_{eff2}$ are respectively effective mobility of charge carriers of the transistor M6 and the transistor M7, and S1 and S2 are two relative proportion values (usage of the two proportion values will be described in follows).

In addition, the differential pair 760 includes a transistor M8 and a transistor M9, wherein a gate of the transistor M8 is coupled to the voltage V3, a first source/drain and a base thereof is coupled to the common terminal of the differential pair 760, and a second source/drain thereof is coupled to the ground voltage. Moreover, a gate of the transistor M9 is coupled to a second input terminal of the differential pair 760, and outputs the output voltage VREF. The channel size of the transistor M9 is similar to that of the differential pair 740, which is B times compared to that of the transistor M8. The first source/drain and the base of the transistor M9 is coupled to the common terminal of the differential pair 760, and the second source/drain thereof is coupled to the current mirror 770.

A current ID4 flows through the common terminal of the differential pair 760 to function as the bias current. The fourth current I4 is also shunted into two currents within the differential pair 760, wherein the current flows through the transistor M8 is a current ID3, and the current flows through the transistor M9 is a current ID4. The differential pair 760 may further include a transistor M15, wherein a first source/drain and a gate of the transistor M15 is coupled to the second source/drain of the transistor M8, and a second source/drain of the transistor M15 is coupled to the ground voltage. The transistor M15 is used for balancing the channel size between the transistor M8 and the transistor M9 during chip fabrication, so as to reduce fabrication errors thereof.

In the present embodiment, similar to the differential pair 740, the fourth voltage VREF is subtracted from the voltage V3 via the differential pair 760. Under function of the current mirror 770, the fourth voltage VREF of the differential pair 760 is determined, wherein a relationship among the voltage V3, the fourth voltage VREF, the current ID3 and the current ID4 is represented by a following equation (2):

$$V3 - VREF = \sqrt{\frac{2 \times ID4}{\mu_{eff4} \times C_{ox} \times S4}} - \sqrt{\frac{2 \times ID3}{\mu_{eff3} \times C_{ox} \times S3}} \quad (2)$$

wherein $_{eff3}$ and $_{eff4}$ are respectively an effective mobility of charge carriers of the transistor M8 and the transistor M9, and S3 and S4 are two relative proportion values. Since the size of the differential pair 740 is A times compared to that of the differential pair 760 (i.e. the channel size of the transistor M6 is A times compared to that of the transistor M8, and the channel size of the transistor M7 is A times compared to that of the transistor M9), a relation among S1, S2, S3 and S4 then will be represented by a following mathematic equation (3):

$$S1 = A \times S3,\ S2 = A \times S4 \quad (3)$$

The third voltage V3 in the mathematic equation (2) is generated by voltage dividing of the voltage divider 750. The voltage divider 750 includes a first voltage dividing device coupled to the second voltage V2 and a second voltage dividing device coupled between the first voltage dividing device and the ground voltage. The third voltage V3 is obtained from a coupling position of the first voltage dividing device and the second voltage dividing device. In the present embodiment, the voltage dividing devices are transistors connected in serial.

First sources/drains of the serial connected transistors are coupled to bases thereof, and gates of the serial connected transistors are coupled to second sources/drains thereof. These transistors are serially connected between the ground voltage and the second voltage V2. As shown in FIG. 7, only two transistors M10 and M11 are connected in series, and the third voltage V3 is then ½ of the second voltage V2. If a plurality of the transistors, for, example, three transistors are connected in series, the third voltage V3 is then ⅔ or ⅓ of the second voltage V2. To minimize the power consumption, these transistors are designed to be in a sub-threshold region for reducing current depletion inevitably generated within a general impedance circuit.

In addition, a first terminal of the current mirror 770 is coupled to the output terminal of the differential pair 740, and a second terminal thereof is coupled to the output terminal of the differential pair 760. The current flowing through the second terminal of the current mirror 770 is amplified by G times, such that a ratio between the current flows through the first terminal thereof and the current flowing through the second terminal thereof is 1:G. Namely, the current ID4 is G times compared to the current ID2, and the current ID3 is G times compared to the current ID1, which will be represented by a following equation (4):

$$ID3=G\times ID1,\ ID4=G\times ID2 \tag{4}$$

According to the equations (1)~(4), and assuming $_{eff1}=_{eff2}=_{eff3}=_{eff4}$, the fourth voltage VREF is then represented by a following equation (5):

$$VREF=\left(\sqrt{\frac{2G\times ID1}{\mu_{eff3}\times C_{ox}\times S3}}-\sqrt{\frac{2G\times ID2}{\mu_{eff4}\times C_{ox}\times S4}}\right)+V3 \tag{5}$$

$$VREF=\sqrt{A\times G}\times\left(\sqrt{\frac{2G\times ID1}{\mu_{eff3}\times C_{ox}\times (A\times S3)}}-\sqrt{\frac{2G\times ID2}{\mu_{eff4}\times C_{ox}\times (A\times S4)}}\right)+V3$$

$$VREF=\sqrt{A\times G}\times\Delta V+V3$$

Deduced by analogy, the temperature coefficient of the output voltage VREF will be effectively compensated by choosing suitable values of parameters A and G. Since the third voltage V3 having the negative temperature coefficient is decreased by the voltage divider 750, relatively great values of the parameters A and G are unnecessary, and accordingly the circuit area is effectively reduced. Moreover, the transistors utilized in the voltage divider 750 used for decreasing the negative temperature coefficient all work on sub-threshold region, and therefore current consumption is reduced which matches a requirement of low power consumption.

However, though a high quality voltage generating apparatus will be provided by the circuit of the aforementioned embodiment, some shortcomings thereof still exist. The mathematic equation (5) is not as simple as it looks especially due to selection of the values of the parameters A and G. The current amplification multiple G equals to a ratio between the current ID4 and the current ID2, and meanwhile equals to a ratio between the current ID3 and the current ID1. Value of the parameter A equals to the amplification multiple of the differential pair 740, and meanwhile equals to the amplification multiple of the differential pair 760. However, when the temperature changes, whether or not the values of the parameters A and G may maintain a normal relation is a main factor of whether or not the equation (5) is applicable.

Figure 8A:
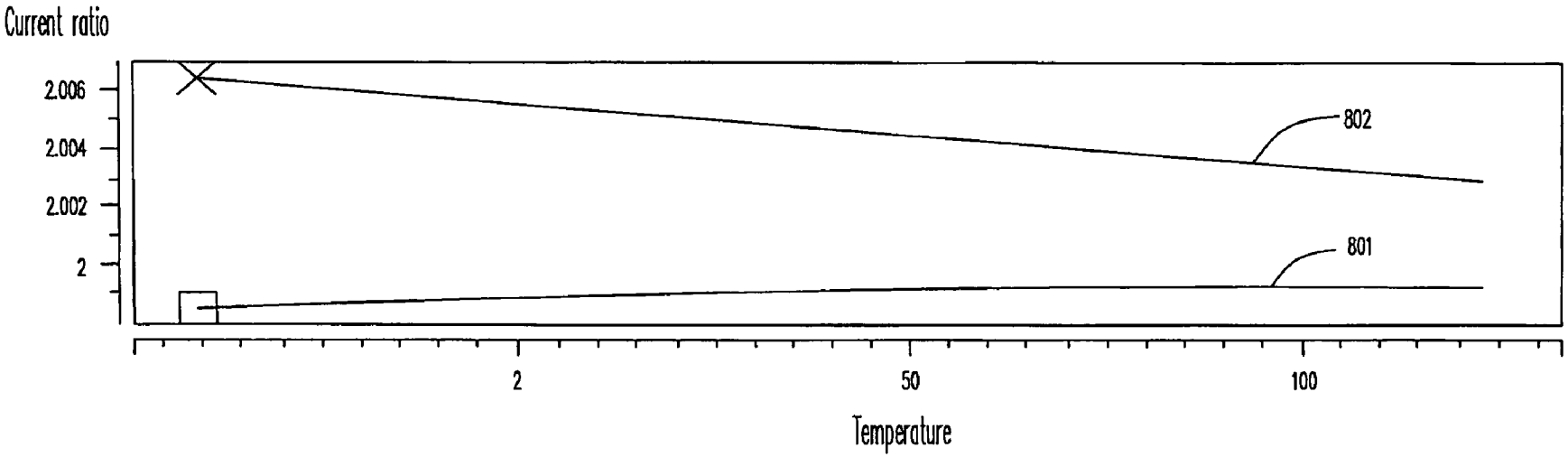
FIG. 8A is a diagram illustrating a relation between temperature and a ratio of currents between two terminals of a differential pair.
Figure 8B:
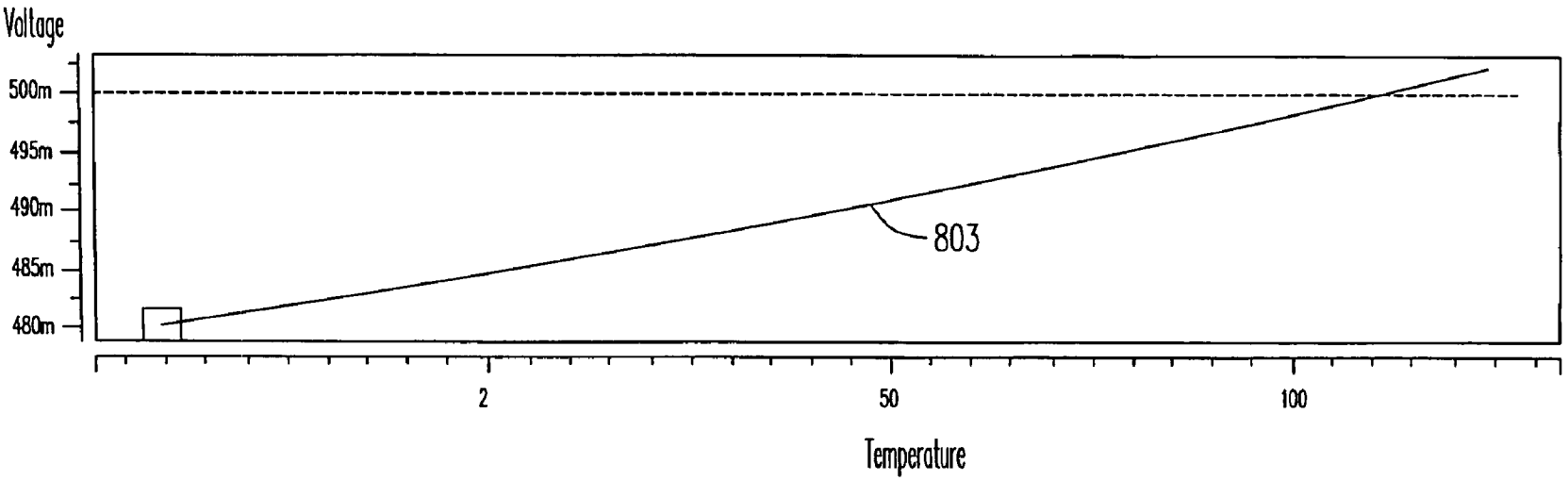
FIG. 8B is a diagram illustrating a relation between temperature and an output voltage of a voltage generating apparatus having a temperature compensation capability.

FIG. 8A is a diagram illustrating a relation between a ratio of currents between two terminals of a differential pair and temperature variations. A curve 801 represents the ratio of the current ID4 and the current ID2, and a curve 802 represents the ratio of the current ID3 and the current ID1. According to FIG. 8A, when the temperature equals −40° C., the two curves have a maximum difference, and now the two curves only have 0.3% difference there between. Therefore, the value G will be considered unchanged along with temperature variation. Referring to FIG. 8B again, FIG. 8B is a diagram illustrating a relation between a fourth voltage VREF and temperature variations. In FIG. 8B, a curve 803 represents variations of the fourth voltage VREF along with the temperature. Wherein, the fourth voltage VREF increases as the temperature increases, which is not as expected that the fourth voltage VREF is unrelated to the temperature. This is because mismatch of value A under temperature variations (i.e. the amplification ratios of the differential pair 740 and the differential pair 760 cannot be maintained to the value A) due to decreasing effective mobility of charge carriers of the transistor when the temperature increases. Considering the above factors, $\sqrt{A\times G}$ then will be changed to a following equation (6):

$$\sqrt{A\times G}=a'+b'T+c'T^2 \tag{6}$$

wherein a', b' and c' are constant numbers unrelated to the temperature, and T represents the temperature.

Therefore, another embodiment is provided to further solve such problem, so as to obtain a voltage generating apparatus with a much higher quality.

Figure 9:
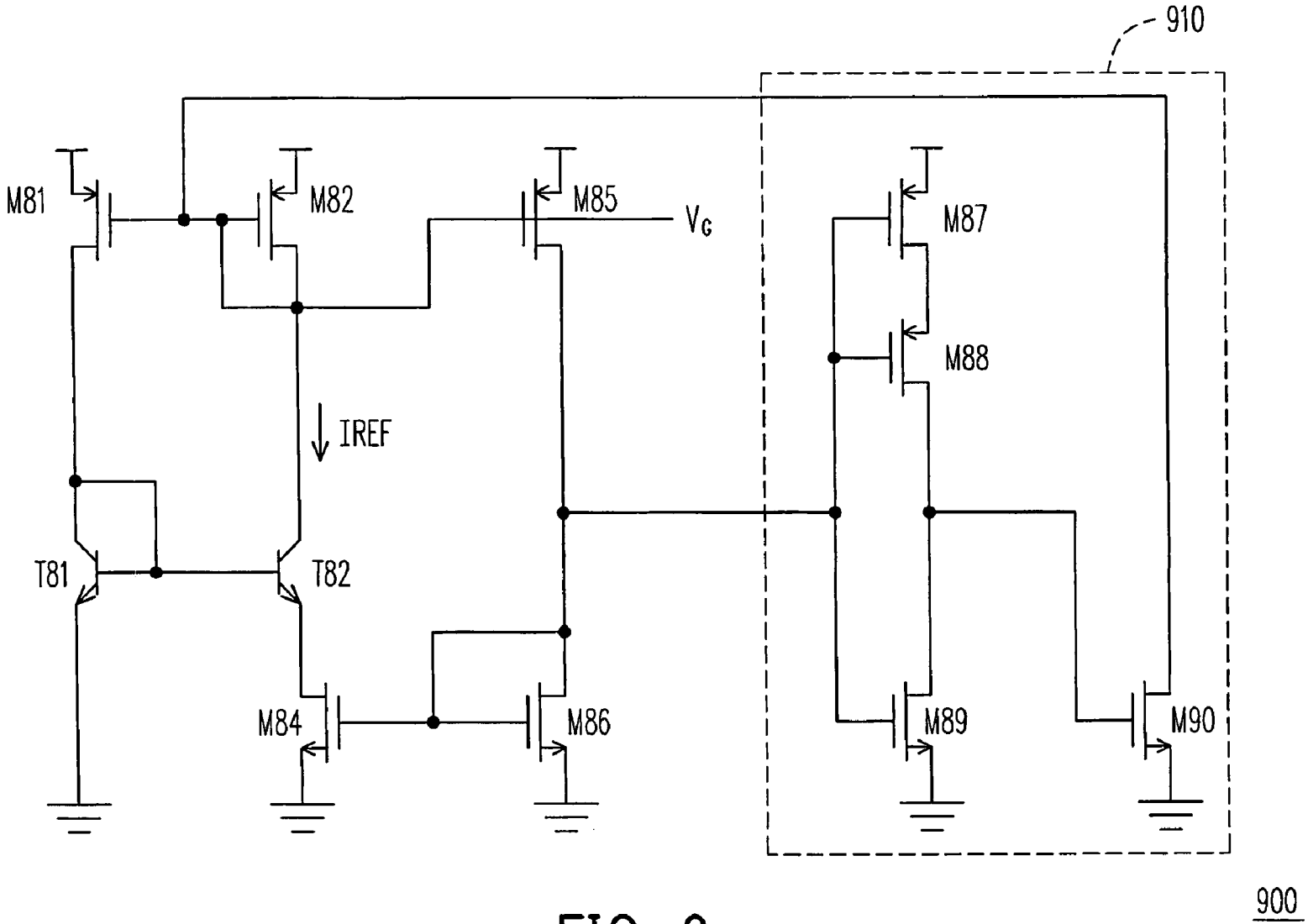
FIG. 9 is a circuit diagram of a voltage generator according to another embodiment of the present invention.

FIG. 9 is a circuit diagram of a voltage generator according to another embodiment of the present invention. Referring to FIG. 9, the circuit of FIG. 9 generates a fifth voltage VOUT coupled to the control terminal $V_G$ of the current source 710 of the former embodiment shown as FIG. 7.

Referring to FIG. 9 again, the voltage generator of the present embodiment includes CMOSs M81~M86, and BJTs T81 and T82. Wherein, a first source/drain of the transistor M81 is coupled to a system voltage. A first source/drain of the transistor M82 is coupled to the system voltage, a gate of the transistor M82 is coupled to the gate of the transistor M81, and a second source/drain of the transistor M82 is coupled to the gate of the transistor M82. Moreover, an emitter of the transistor T81 is coupled to the ground voltage, and a base and a collector of the transistor T81 are coupled to the second source/drain of the transistor M81. A base of the transistor T82 is coupled to the base of the transistor T81, and a collector of the transistor T82 is coupled to the gate of the transistor M82 to form a feedback loop. It should be noted that a regional area the emitter of the transistor T82 is N times compared to that of the transistor T81, wherein N is a rational number.

Referring to FIG. 9 again, a first source/drain of the transistor M84 is coupled to the emitter of the transistor T82, and a second source/drain of the transistor M84 is coupled to the ground voltage. A gate and a first source/drain of the transistor M86 is coupled to a gate of the transistor M84, and a second source/drain of the transistor M86 is coupled to the ground voltage. A gate of the transistor M85 is coupled to the gate of the transistor M82, a first source/drain of the transistor M85 is coupled to the system voltage, and a second source/drain of the transistor M85 is coupled to the first source/drain of the transistor M86.

According to the coupling status of the transistors, the transistors M81, M82, T81 and T82 may form a current source to generate a reference current IREF which flows between the transistor M82 and the transistor T82. The transistors M85 and M86 mirror the reference current IREF and generate another reference current which flows between the transistor M85 and the transistor M86, and with a value of X IREF.

Moreover, the transistor M84 is designed to work on linear region, such that the transistor M84 is equivalent a voltage control resistor. The transistors M86, M82 and M85 may form a feedback loop for generating a required control voltage for the transistor M84. The transistors T81 and T82 are used for providing a drain to source voltage VBE of the transistor M84, so as to maintain the transistor M84 within the linear region. According to the above relationship, the reference current IREF will be represented by a following equation (7):

$$IREF = \frac{1}{2}\cdot\left\{-\left(1-\frac{\beta_{e1}}{\beta_{e2}}\cdot 2\alpha\right)+\left[\left(1-\frac{\beta_{e1}}{\beta_{e2}}\cdot 2\alpha\right)^2-1\right]^{\frac{1}{2}}\right\}\cdot \beta_{e1}\cdot(\Delta VBE)^2 = K\cdot\beta_{e1}\cdot(\Delta VBE)^2 \quad (7)$$

wherein the parameters $\beta_{c1}$ and $\beta_{c2}$ are respectively a multiplication of an effective mobility of charge carriers, a capacitance of gate oxide capacitance per unit area and a width-length ratio of transistor channel of the transistors M84 and M86, i.e. $\mu_{eff}C_{ox}$(W/L). The drain-source voltage VBE of the transistor M84 in the equation equals to VT ln(N), wherein VT is a thermal voltage, and N is an emitter area ratio between the transistor T82 and the transistor T81.

Figure 10:
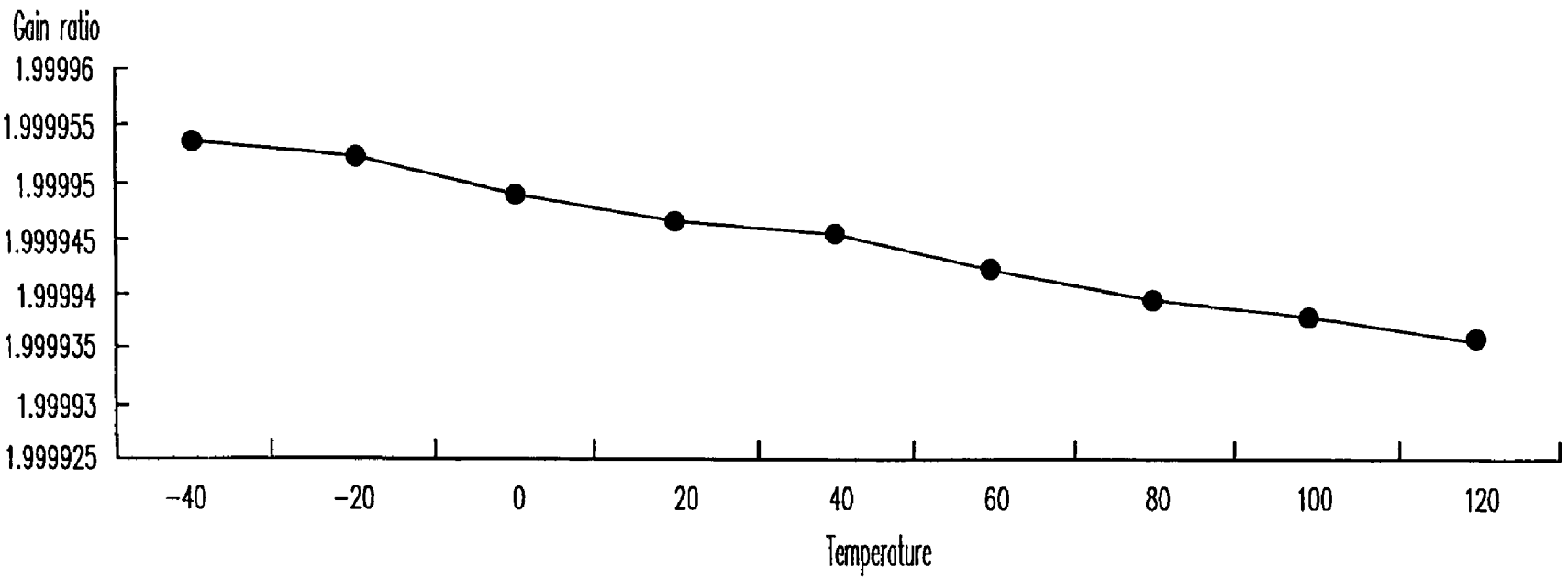
FIG. 10 is a diagram illustrating a relation between ratio of parameters $\beta_{c1}$ and $\beta_{c2}$ and temperature.

In addition, since the gate-source voltage of the transistor M84 is the same to that of the transistor M86, the transistor M84 and the transistor M86 have the same effective mobility of charge carriers under the same temperature. Referring to FIG. 10, FIG. 10 is a diagram illustrating a relation between a ratio of parameters $\beta_{c1}$ and $\beta_{c2}$ and temperature variations. According to FIG. 10, it is obvious that the ratio of parameters $\beta_{c1}$ and $\beta_{c2}$ has only little change when temperature changes, and therefore the ratio of parameters $\beta_{c1}$ and $\beta_{c2}$ will be considered to be unrelated to variation of temperature. A mirroring ratio for the transistors M86 and M85 mirroring the reference current IREF is also unrelated to variation of the temperature. In summary, the parameter K in the mathematic equation (7) may also be a parameter unrelated to variation of the temperature.

Referring to FIG. 7 and the mathematic equation (5) again, $\sqrt{A\times G}$ will be changed to $(a'+b'T+c'T^2)$, and V will be changed to VT×ln FN', wherein F is a ratio of the third current I3 and the first current I1, and N' a ratio of emitter areas between the transistor T2 and the transistor T1 of the second voltage source 730 and the first voltage source 720. If a voltage dividing ratio of the voltage divider 750 is ½, an equation (8) will be deduced from equation (5) as follows (wherein since the second voltage V2 relates to the temperature, it will be represented as V2(T)):

$$VREF = \frac{1}{2}\cdot V2(T) + (a' + b'T + c'T^2)\cdot VT\times \ln FN' \quad (8)$$

In addition, to implement a more accurate compensation, the second voltage V2 will be further changed as shown in an equation (9) according to a thesis entitled "Accurate analysis of temperature effects in $I_C$-$V_{BE}$ characteristics with application to bandgap reference sources" disclosed in Journal of solid-state circuits at vol. 15, pages 1076 to 1084 on December, 1980 by institute of electrical and electronic engineers (IEEE), and the equation (9) is as follows:

$$VREF = \left[\begin{array}{l}\frac{1}{2}\cdot V_G(T) - \left(\frac{T}{T_r}\right)\cdot V_G(T_r) + \left(\frac{T}{T_r}\right)\cdot \\ V2(T_r) - (\eta-\delta)\cdot\left(\frac{kT}{q}\right)\cdot\ln\left(\frac{T}{T_r}\right)\end{array}\right] + (a' + b'T + c'T^2)\cdot V_T \ln FN' \quad (9)$$

wherein and are constant values defined by the thesis, $V_G$(T) is a voltage of the control terminal $V_G$ of the current source 810 under a temperature T, and $V_G(T_r)$ is a voltage of the control terminal $V_G$ under a reference temperature $T_r$.

Referring to FIG. 7 and FIG. 9, the voltage generator of FIG. 9 generates the fifth voltage VOUT according to the reference voltage IREF and transmits the fifth voltage VOUT to the control terminal $V_G$ illustrated in FIG. 7. Then, the current source 710 of FIG. 7 generates different currents according to the fifth voltage VOUT received by the control terminal $V_G$. According to the equation (7), the fifth voltage VOUT will be represented by a formula related to a square of the temperature, which represents the fifth voltage VOUT has a high order term temperature compensation coefficient. The fifth voltage VOUT will be further represented by an equation (10) shown as follows (wherein the fifth voltage VOUT will be varied along with the temperature, and therefore in the following equation, the fifth voltage VOUT is represented by VOUT(T)):

$$VOUT(T)=a-bT-cT^2 \quad (10)$$

Since the $V_G$(T) equals to VOUT(T), the high order terms (first order term and quadratic term) of the equation (9) then will be represented by a mathematic equation (11), shown as follows (wherein KT/q equals to a thermal voltage):

$$O(T^n) = \frac{1}{2}\cdot\left[-cT^2 - (\eta-\delta)\cdot\left(\frac{kT}{q}\right)\cdot\ln\left(\frac{T}{T_r}\right)\right] + (b'T + c'T^2)\cdot\frac{kT}{q}\cdot\ln FN' \quad (11)$$

and by selecting suitable parameters b' and c', the high order terms in the equation (11) then will be eliminated, such that under different values of the temperature T, the mathematic equation (11) may all approximately equal to 0.

It should be noted that the present embodiment further includes a start-up circuit 910. The start-up circuit 910 includes a transistor M87, a transistor M88, a transistor M89 and a transistor M90. A first source/drain of the transistor M87 is coupled to the system voltage. A gate of the transistor M88 is coupled to a gate of the transistor M87, and a first source/drain of the transistor M88 is coupled to a second source/drain of the transistor M87. A gate of the transistor M89 is coupled to the gate of the transistor M87, a first source/drain of the transistor M89 is coupled to a second source/drain of the transistor M88, and a second source/drain of the transistor M89 is coupled to the ground voltage. Moreover, a gate of the transistor M90 is coupled to the first source/drain of the transistor M89, a first source/drain of the transistor M90 is coupled to the gate of the transistor M81, and a second source/drain of the transistor M90 is coupled to the ground voltage.

The start-up circuit 910 is used for providing a feedback voltage to the voltage generator 900 at the moment the power is supplied, so as to prevent generation of glitch on the fifth voltage VOUT, and accordingly burning of the circuit or mis-operation of related circuit coupled to the fifth voltage VOUT is avoided.

Figure 11A:
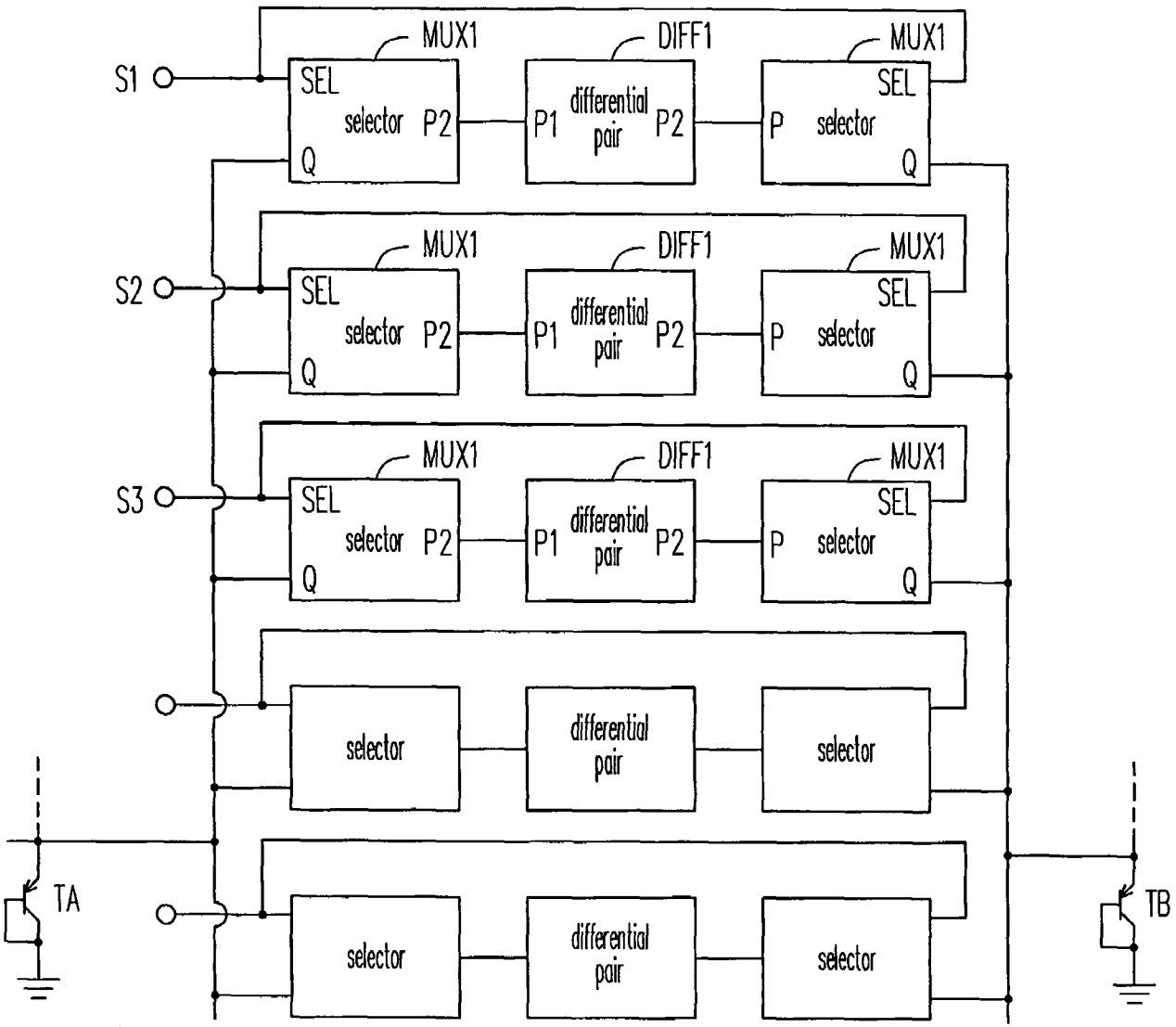
FIG. 11A is a diagram illustrating a method of adjusting size of a differential pair according to an embodiment of the present invention.
Figure 11B:
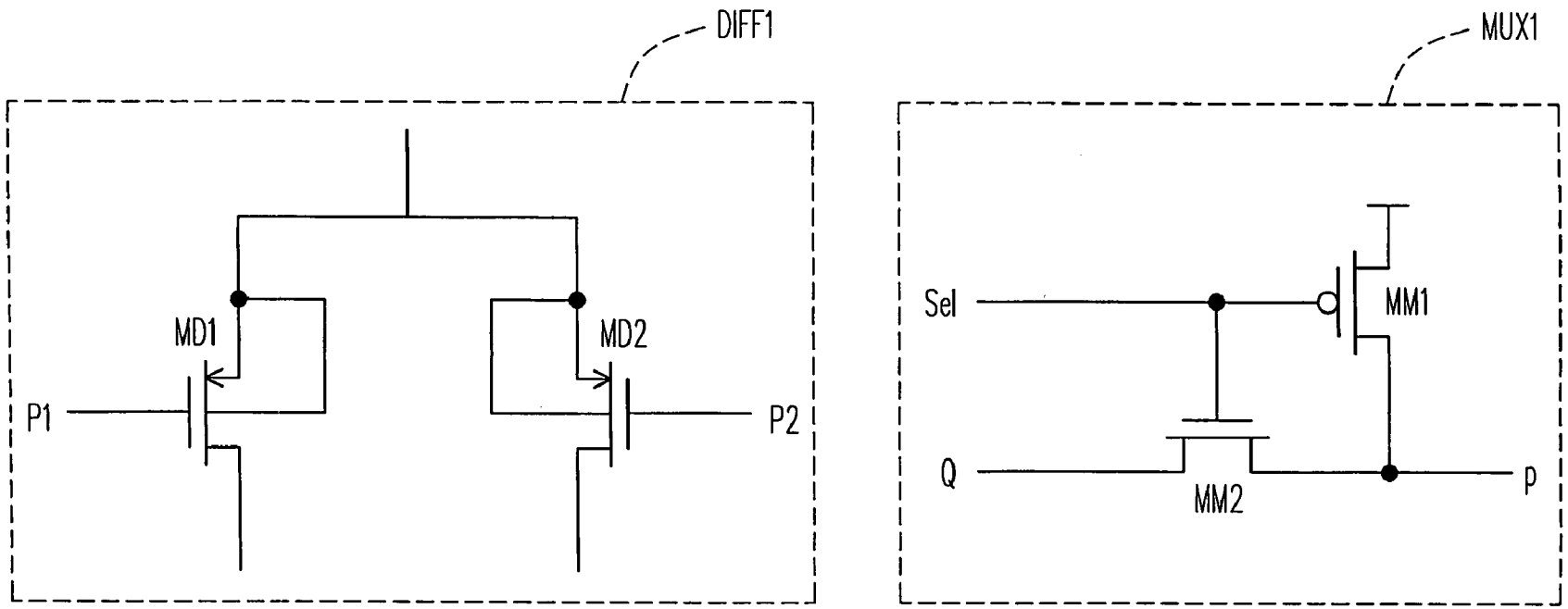
FIG. 11B is amplified schematic diagram illustrating a selector and a differential pair of FIG. 11A.

FIG. 11A is a diagram illustrating a method of adjusting size of a differential pair according to an embodiment of the present invention. FIG. 11B is a circuit diagram illustrating a selector MUX1 and a differential pair DIFF1 of FIG. 11A. Referring to FIG. 11A and FIG. 11B, selection signals S1-S3 are transmitted to the selector MUX1 via a terminal SEL, and a terminal Q of the selector MUX1 is coupled to a transistor TA or a transistor TB, another terminal P of the selector MUX1 is coupled to a terminal P1 or a terminal P2 of the differential pair DIFF1.

When the selection signal S1 equals to 0, a transistor MM1 of the corresponding selector MUX1 is turned on, and a transistor MM2 thereof is turned off, such that transistors MD1 and MD2 of the differential pair DIFF1 coupled to the selector MUX1 are disabled. Conversely, when the selection signal S1 equals to 1, the transistor MM1 of the corresponding selector MUX1 is turned off, and the transistor MM2 thereof is turned on, such that the transistors MD1 and MD2 of the differential pair DIFF1 coupled to the selector MUX1 are respectively connected to the transistor TA and the transistor TB. If a relatively small sized differential pair is required, relatively less selection signals equal to 1, and if a relatively large sized differential pair is required, relatively more selection signals equal to 1. For example, if the selection signal S1 is 1, and the selection signals S2 and S3 are 0, the size of the differential pair is then the minimum size, which has only one unit. If the selection signals S1~S3 are all 1, the size of the differential pair is then the maximum size, which has three units.

Figure 12:
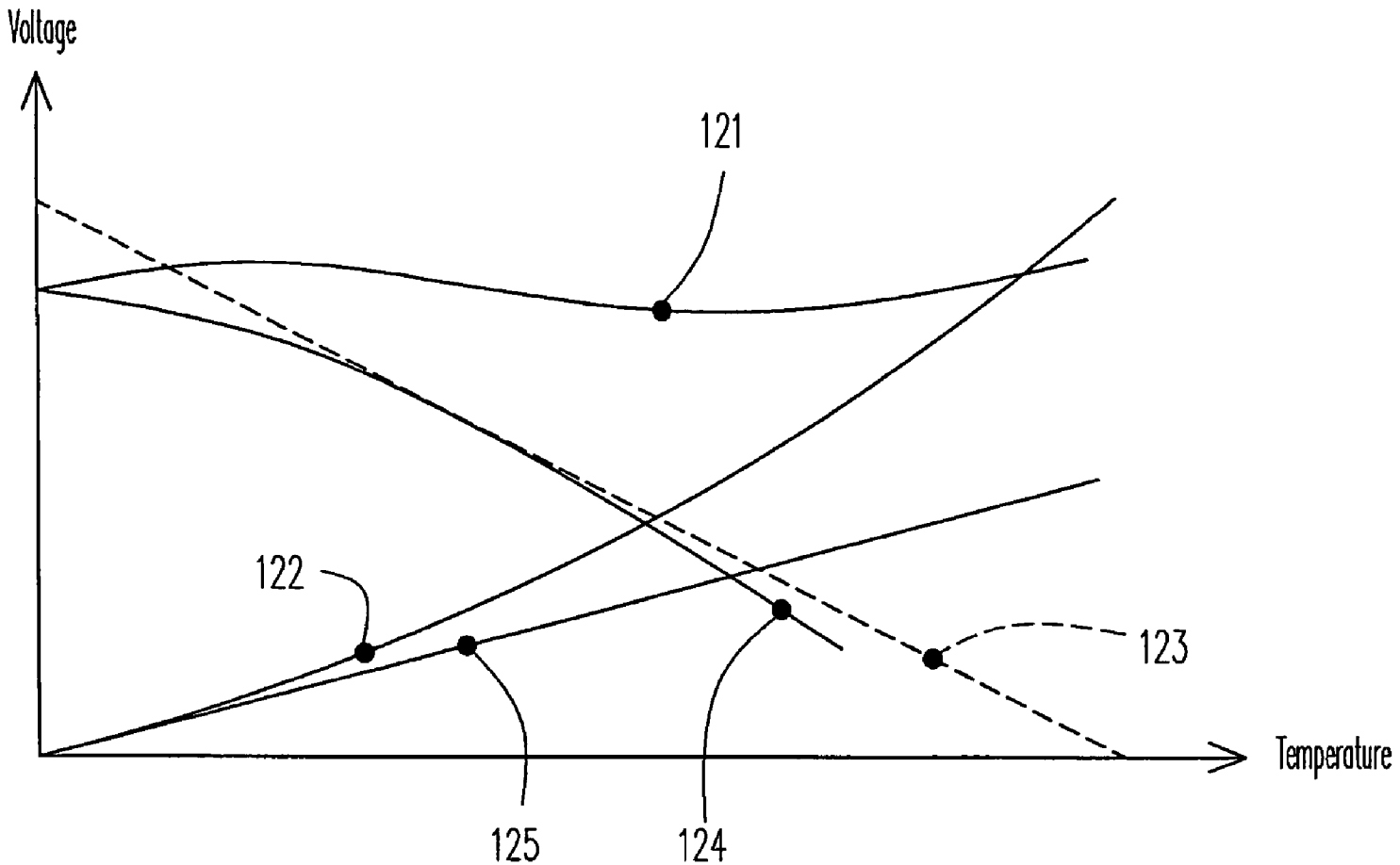
FIG. 12 is a schematic diagram illustrating a quadratic compensation method according to an embodiment of the present invent ion.

Accordingly, with reference of FIG. 12, spirit of a quadratic compensation method of the present embodiment will be fully described. FIG. 12 is a schematic diagram illustrating a quadratic compensation method according to an embodiment of the present invention. A curve 121 represents a relationship between the temperature of the compensated fourth voltage VREF and the voltage. A curve 122 represents a relationship between a multiplication of the source-drain voltage VBE of the transistor M84 with and $\sqrt{A \times G}$ temperature variations. A curve 123 represents a relationship between the voltage and the temperature while only the first order term of the second voltage being considered. A curve 124 represents a relation between an actual temperature of the second voltage V2 and the voltage. A curve 125 represents a relationship between the temperature and the source-drain voltage VBE of the transistor M84.

Referring to FIG. 12 again, increasing rate of the curve 122 along with increasing of the temperature will be increased by improving a ratio F of the third current I3 and the first current I1. Based on such increasing rate, a situation that the second voltage V2 actually decreases as the temperature increases as shown by the curve 124 will be compensated, and therefore the so-called quadratic compensation is achieved.

In summary, by only applying a structure of active devices, temperature compensation of the voltage generating apparatus will be implemented. Moreover, the negative temperature coefficient that may cause enlargement of circuit area will be effectively reduced, and therefore cost of the temperature compensation circuit is reduced. The present invention also provides a high order term compensation method, such that an accurate temperature compensation of the voltage generating apparatus will be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage generating apparatus, comprising:

a current source, for generating a first current, a second current, a third current and a fourth current;

a first voltage source, coupled to the current source, for generating a first voltage according to the first current, wherein the first voltage has a first negative temperature coefficient;

a second voltage source, coupled to the current source, for generating a second voltage according to the third current, wherein the second voltage has a second negative temperature coefficient, and the first negative temperature coefficient is lower than the second negative temperature coefficient;

a first differential pair, having a first input terminal, a second input terminal, a common terminal and an output terminal, wherein the first input terminal is coupled to the first voltage, the second input terminal is coupled to the second voltage, and the second current flows through the common terminal;

a voltage divider, for receiving and dividing the second voltage, so as to output a third voltage;

a second differential pair, having a first input terminal, a second input terminal, a common terminal and an output terminal, wherein the first input terminal is coupled to the third voltage, the second terminal is coupled to the output terminal for outputting a fourth voltage, and the fourth current flows through the common terminal; and a current mirror, having a first terminal and a second terminal, wherein the first terminal is coupled to the output terminal of the first differential pair, and the second terminal is coupled to the output terminal of the second differential pair.

2. The voltage generating apparatus as claimed in claim 1, wherein a ratio between the first current and the third current is 1:F, a ratio between the second current and the fourth current is 1:G, and F and G are rational numbers.

3. The voltage generating apparatus as claimed in claim 1, wherein an amplifying ratio between the first input terminal and the second input terminal of the first differential pair is A:AB, and A and B are rational numbers.

4. The voltage generating apparatus as claimed in claim 1, wherein the third voltage has a third negative temperature coefficient, and a ratio between the third negative temperature coefficient and the second negative temperature coefficient is equivalent to a voltage dividing ratio of the voltage divider.

5. The voltage generating apparatus as claimed in claim 1, wherein an amplifying ratio between the first input terminal and the second input terminal of the second differential pair is 1:B.

6. The voltage generating apparatus as claimed in claim 1, wherein a ratio between a current flowing through the first terminal of the current mirror and a current flowing through the second terminal of the current mirror is 1:G.

7. The voltage generating apparatus as claimed in claim 1, wherein the voltage divider comprises:

a first voltage dividing device, coupled to the second voltage; and a second voltage device, coupled between the first voltage dividing device and a ground voltage, wherein the third voltage is obtained from a coupling position of the first voltage dividing device and the second voltage dividing device.

8. The voltage generating apparatus as claimed in claim 7, wherein the first voltage dividing device and the second voltage dividing device respectively comprises:

a first transistor, having a first source/drain, a second source/drain, a gate and a base, wherein the first source/drain and the base are coupled to the second voltage, and the gate is coupled to the second source/drain; and a second transistor, having a first source/drain, a second source/drain, a gate and a base, wherein the first source/drain and the base are coupled to the gate of the first transistor, and the gate and the second source/drain are coupled to the ground voltage.

9. The voltage generating apparatus as claimed in claim 1 further comprising a voltage generator coupled to the current source for generating a fifth voltage, wherein the fifth voltage has a quadratic term temperature coefficient.

10. The voltage generating apparatus as claimed in claim 9, wherein the voltage generator comprises:

a first transistor, having a first source/drain, a second source/drain and a gate, wherein the first source/drain is coupled to a system voltage;

a second transistor, having a first source/drain, a second source/drain and a gate, wherein the first source/drain is coupled to the system voltage, the gate is coupled to the gate of the first transistor, and the second source/drain is coupled to the gate thereof;

a third transistor, having an emitter, a base and a collector, wherein the emitter is coupled to the ground voltage, and the base and the collector are coupled to the second source/drain of the first transistor;

a fourth transistor, having an emitter, a base and a collector, wherein the base is coupled to the base of the third transistor, the collector is coupled to the gate of the second transistor, and regional area of the emitter is N times compared to regional area of the emitter of the third transistor, wherein N is rational number;

a fifth transistor, having a first source/drain, a second source/drain and a gate, wherein the first source/drain is coupled to the emitter of the fifth transistor, and the second source/drain is coupled to the ground voltage;

a sixth transistor, having a first source/drain, a second source/drain and a gate, wherein the gate and the first source/drain are coupled to the gate of the fifth transistor, and the second source/drain is coupled to the ground voltage; and a seventh transistor, having a first source/drain, a second source/drain and a gate, wherein the gate is coupled to the gate of the second transistor, the first source/drain is coupled to the system voltage, and the second source/drain is coupled to the first source/drain of the sixth transistor.

11. The voltage generating apparatus as claimed in claim 10, wherein the voltage generator further comprises a start-up circuit for stabling the fifth voltage at a moment the voltage generator is started, wherein the start-up circuit comprises:

an eighth transistor, having a first source/drain, a second source/drain and a gate, wherein the first source/drain is coupled to the system voltage;

a ninth transistor, having a first source/drain, a second source/drain and a gate, wherein the gate is coupled to the gate of the eighth transistor, and the first source/drain is coupled to the second source/drain of the eighth transistor;

a tenth transistor, having a first source/drain, a second source/drain, and a gate, wherein the gate is coupled to the gate of the eighth transistor, the first source/drain is coupled to the second source/drain of the ninth transistor, and the second source/drain is coupled to the ground voltage; and an eleventh transistor, having a first source/drain, a second source/drain and a gate, wherein the gate is coupled to the first source/drain of the tenth transistor, the first source/drain is coupled to the fifth voltage, and the second source/drain is coupled to the ground voltage.

12. The voltage generating apparatus as claimed in claim 1, wherein the current source comprises:

a control terminal;

a first transistor, having a first source/drain, a second source/drain and a gate, wherein the gate is coupled to the control terminal, the first source/drain is coupled to the system voltage, and the second source/drain outputs the first current;

a second transistor, having a first source/drain, a second source/drain and a gate, wherein the gate is coupled to the control terminal, the first source/drain is coupled to the system voltage, and the second source/drain outputs the second current;

a third transistor, having a first source/drain, a second source/drain and a gate, wherein the gate is coupled to the control terminal, the first source/drain is coupled to the system voltage, and the second source/drain outputs the third current, wherein a channel width ratio between the first transistor and the third transistor is 1:F; and a fourth transistor, having a first source/drain, a second source/drain and a gate, wherein the gate is coupled to the control terminal, the first source/drain is coupled to the system voltage, and the second source/drain outputs the fourth current, wherein a channel width ratio between the second transistor and the fourth transistor is 1:G.

13. The voltage generating apparatus as claimed in claim 1, wherein the first voltage source comprises a first diode having a cathode and an anode, wherein the anode is used for receiving the first current to obtain the first voltage, and the cathode is coupled to the ground voltage.

14. The voltage generating apparatus as claimed in claim 13, wherein the first diode comprises a transistor having an emitter, a collector and a base, wherein the emitter is used for receiving the first current to obtain the first voltage, and the base and the collector are coupled to the ground voltage.

15. The voltage generating apparatus as claimed in claim 1, wherein the second voltage source comprises a second diode having a cathode and an anode, wherein the anode is used for receiving the third current to obtain the second voltage, and the cathode is coupled to the ground voltage.

16. The voltage generating apparatus as claimed in claim 15, wherein the second diode comprises a transistor having an emitter, a collector and a base, wherein the emitter is used for receiving the third current to obtain the second voltage, and the base and the collector are coupled to the ground voltage.

17. The voltage generating apparatus as claimed in claim 1, wherein the first differential pair comprises:

a first transistor, having a first source/drain, a second source/drain and a gate, wherein the gate is coupled to the first input terminal of the first differential pair, the first source/drain and the base are coupled to the common terminal of the differential pair, and the second source/drain is coupled to the ground voltage; and a second transistor, having a first source/drain, a second source/drain and a gate, wherein the gate is coupled to the second input terminal of the first differential pair, the first source/drain and the base are coupled to the common terminal of the first differential pair, and the second source/drain is coupled to the current mirror.

18. The voltage generating apparatus as claimed in claim 17, wherein the first differential pair further comprises a third transistor having a first source/drain, a second source/drain and a gate, wherein the gate and the first source/drain are coupled to the second source/drain of the first transistor, and the second source drain is coupled to the ground voltage.

19. The voltage generating apparatus as claimed in claim 1, wherein the second differential pair comprises:

a first transistor, having a first source/drain, a second source/drain and a gate, wherein the gate is coupled to the first input terminal of the second differential pair, the first source/drain and a base thereof are coupled to the common terminal of the second differential pair, and the second source/drain is coupled to the ground; and a second transistor, having a first source/drain, a second source/drain and a gate, wherein the gate is coupled to the second input terminal of the second differential pair, the first source/drain and a base thereof are coupled to the common terminal of the second differential pair, and the second source/drain is coupled to the current mirror.

20. The voltage generating apparatus as claimed in claim 19, wherein the second differential pair further comprises a third transistor having a first source/drain, a second source/drain and a gate, wherein the gate and the first source/drain are coupled to the second source/drain of the first transistor, and the second source/drain is coupled to the ground voltage.

21. The voltage generating apparatus as claimed in claim 1, wherein the current mirror comprises:

a first transistor, having a first source/drain, a second source/drain and a gate, wherein the first source/drain and the gate are coupled to the first terminal of the current mirror, and the second source/drain is coupled to the ground voltage; and a second transistor, having a first source/drain, a second source/drain and a gate, wherein the gate is coupled to the gate of the first transistor, the first source/drain is coupled to the second terminal of the current mirror, and the second source/drain is coupled to the ground voltage.

* * * * *